US011038287B2

(12) United States Patent
Toda

(10) Patent No.: US 11,038,287 B2
(45) Date of Patent: Jun. 15, 2021

(54) CONNECTOR AND CABLE HARNESS

(71) Applicant: JAPAN AVIATION ELECTRONICS INDUSTRY, LIMITED, Tokyo (JP)

(72) Inventor: Kentaro Toda, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 16/896,333

(22) Filed: Jun. 9, 2020

(65) Prior Publication Data

US 2021/0021057 A1 Jan. 21, 2021

(30) Foreign Application Priority Data

Jul. 18, 2019 (JP) ..... JP2019-132705

(51) Int. Cl.
*H01R 4/2416* (2018.01)
*H01R 9/16* (2006.01)

(52) U.S. Cl.
CPC ..... *H01R 4/2416* (2013.01); *H01R 9/16* (2013.01)

(58) Field of Classification Search
CPC ..... H01R 9/16; H01R 4/2416; H01R 12/62; H01R 13/187
See application file for complete search history.

(56) References Cited

U.S. PATENT DOCUMENTS 6,939,174 B2 * 9/2005 Wu ..... H01R 13/514 439/607.05
7,503,776 B1 * 3/2009 Pavlovic ..... H01R 4/46 439/98
8,840,432 B2 * 9/2014 Alden, III ..... H01R 13/6585 439/607.46
10,348,032 B2 7/2019 Yamaguchi et al.
10,411,374 B2 9/2019 Tanaka et al.
2017/0040746 A1 * 2/2017 Zhang ..... H01R 12/62
2019/0260150 A1 * 8/2019 Costello ..... H01R 13/187
2019/0393656 A1 12/2019 Wu et al.

FOREIGN PATENT DOCUMENTS

CN 109038118 A 12/2018
JP 2018056058 A 4/2018
JP 2018152244 A 9/2018
KR 20160126171 A 11/2016

* cited by examiner

*Primary Examiner* — Jean F Duverne
(74) *Attorney, Agent, or Firm* — Holtz, Holtz & Volek PC

(57) ABSTRACT

A connector is attachable with a composite cable and is connectable with a mating connector having a mating contact portion. The composite cable has at least one cable set which comprises a first cable and two second cables. The connector has a first member, a plurality of terminals and a second member. The first member is attachable with the composite cable. The plurality of terminals include at least one terminal set which comprises a first terminal and two second terminals. Each of the terminals has a contact portion, a held portion and a connecting portion. The connecting portion is connected with the composite cable when the connector is attached with the composite cable. In the at least one terminal set, the connecting portion of the first terminal is positioned between the connecting portions of the second terminals in a horizontal direction. The second member is combined with the first member.

10 Claims, 11 Drawing Sheets

CONNECTOR AND CABLE HARNESS

CROSS REFERENCE TO RELATED APPLICATIONS

This application is based on and claims priority under 35 U.S.C. § 119 to Japanese Patent Application No. JP2019-132705 filed Jul. 18, 2019, the contents of which are incorporated herein in their entirety by reference.

BACKGROUND OF THE INVENTION

This invention relates to a connector attachable with a composite cable, and to a cable harness comprising the connector.

KR 2016-0126171A (Patent Document 1) discloses a connector 900 of this type. Referring to FIGS. 19 to 21, the connector 900 of Patent Document 1 is attachable with a composite cable (not shown) which comprises signal lines (not shown) and power supply lines (not shown). The connector 900 has first members 910, terminals 920 and a second member 930. Each of the first members 910 is attached with the composite cable. Each of the first members 910 has first cable holding portions 912 and second cable holding portions 914. When the first member 910 is attached with the composite cable, the first cable holding portion 912 holds the signal line and the second cable holding portion 914 holds the power supply line. The terminals 920 are held by the second member 930. Each of the terminals 920 has a contact portion 922, a held portion 924 and a connecting portion 926. The held portion 924 is held by the second member 930. The connecting portion 926 is connected with the composite cable when the connector 900 is attached with the composite cable. The second member 930 is combined with the first members 910.

In a connector attachable with a composite cable, automated connection of terminals of the connector with the composite cable is required in order to improve manufacturing efficiency of a cable harness comprising the connector and the composite cable. In order to connect the terminals 920 of the connector 900 of Patent Document 1 with the composite cable, the signal lines and the power supply lines are required to be inserted one by one into the first cable holding portions 912 and the second cable holding portions 914, respectively, prior to the connection. In other words, the connector 900 of Patent Document 1 is not suitable for automated connection of the terminals 920 with the composite cable.

SUMMARY OF THE INVENTION

It is therefore an object of the present invention to provide a connector which has a structure suitable for automated connection of terminals with a composite cable.

One aspect of the present invention provides a connector which is attachable with a composite cable and which is connectable with a mating connector having a mating contact portion. The composite cable has at least one cable set which comprises a first cable and two second cables. The connector has a first member, a plurality of terminals and a second member. The first member is attachable with the composite cable. The first member has a base portion and a cable holding portion. The base portion has a flat-plate shape. The cable holding portion is provided on the base portion. The cable holding portion has at least one holding portion set which comprises a first cable holding portion and two second cable holding portions. In the at least one holding portion set, the first cable holding portion is positioned between the base portion and the second cable holding portion in a perpendicular direction perpendicular to the base portion and is positioned between the second cable holding portions in a horizontal direction perpendicular to the perpendicular direction. In the at least one holding portion set, the second cable holding portions are positioned at the same level as each other in the perpendicular direction. When the first member is attached with the composite cable, the first cable holding portion holds the first cable and the second cable holding portions hold the second cables, respectively. The plurality of terminals are held by the second member. The plurality of terminals include at least one terminal set which comprises a first terminal and two second terminals. Each of the terminals has a contact portion, a held portion and a connecting portion. The contact portion is brought into contact with the mating contact portion when the connector is connected with the mating connector. The held portion is held by the second member. The connecting portion is connected with the composite cable when the connector is attached with the composite cable. The connecting portion has an end in the perpendicular direction. In the at least one terminal set, the connecting portion of the first terminal is positioned between the connecting portions of the second terminals in the horizontal direction. The second member is combined with the first member. The second member has an accommodating portion. The accommodating portion accommodates, at least in part, the cable holding portion when the second member is combined with the first member. Under a combined state where the second member is combined with the first member, the connecting portion is exposed in the accommodating portion and protrudes toward an inside of the accommodating portion. Under the combined state, the connecting portion of the first terminal extends toward the first cable holding portion in the perpendicular direction. Under the combined state, the connecting portion of the second terminal extends toward the second cable holding portion in the perpendicular direction. Under the combined state, the end of the connecting portion of the first terminal is positioned between the end of the connecting portion of the second terminal and the base portion in the perpendicular direction.

In the connector of the present invention, the cable holding portion of the first member has the at least one holding portion set which comprises the first cable holding portion and the two second cable holding portions. Accordingly, the connector of the present invention is configured so that the first cable and the second cables of the composite cable can be simultaneously accommodated in the cable holding portion upon connection of the terminals with the composite cable. Thus, the connector of the present invention has a structure suitable for automated connection of the terminals with the composite cable.

An appreciation of the objectives of the present invention and a more complete understanding of its structure may be had by studying the following description of the preferred embodiment and by referring to the accompanying drawings.

Figure 1:
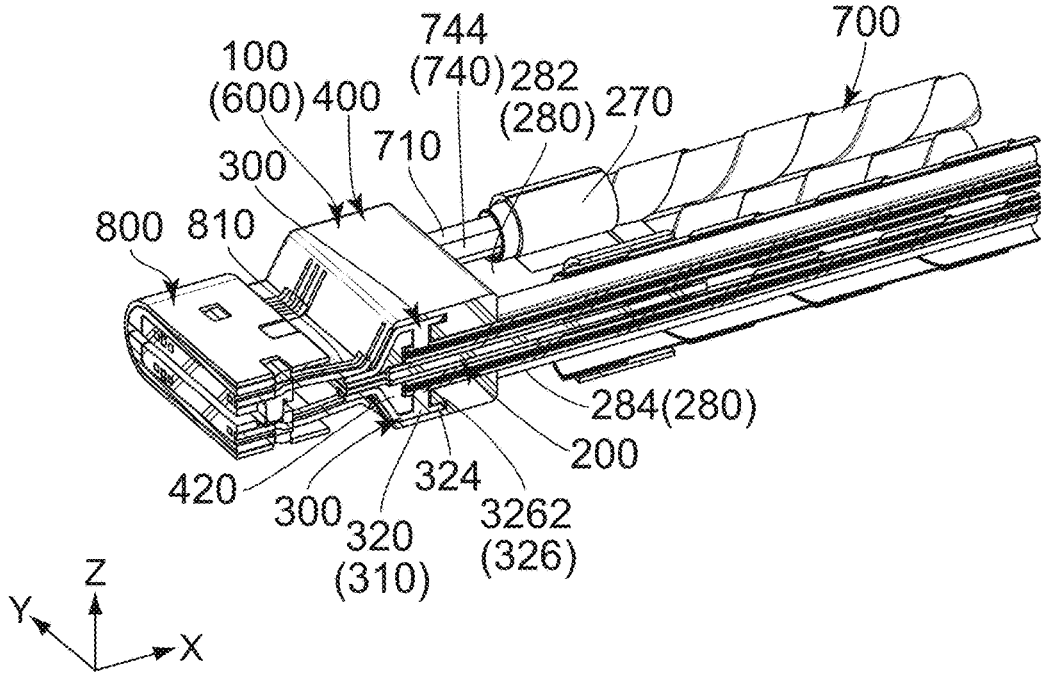
FIG. 1 is a partially cut-away cross-sectional, perspective view showing a mated state where a cable harness and a mating connector according to an embodiment of the present invention are mated with each other.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 2:
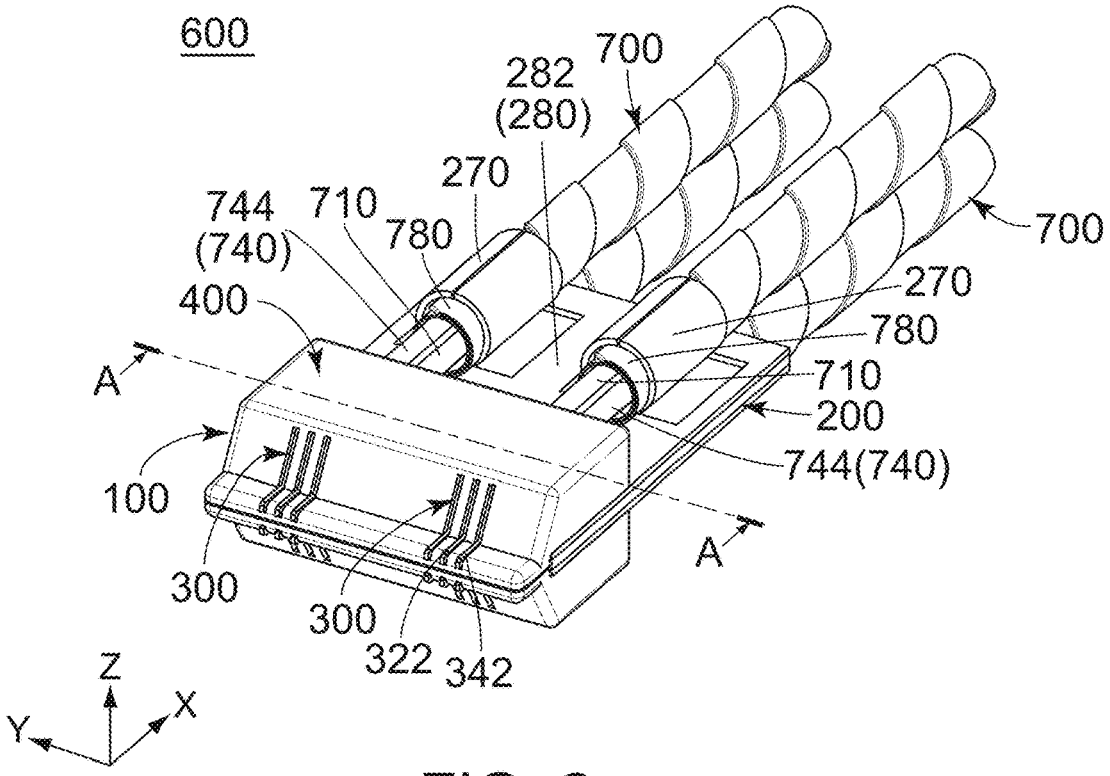
FIG. 2 is a front, perspective view showing the cable harness of FIG. 1.

As shown in FIG. 2, a cable harness 600 according to an embodiment of the present invention comprises a composite cable 700 and a connector 100.

Figure 12:
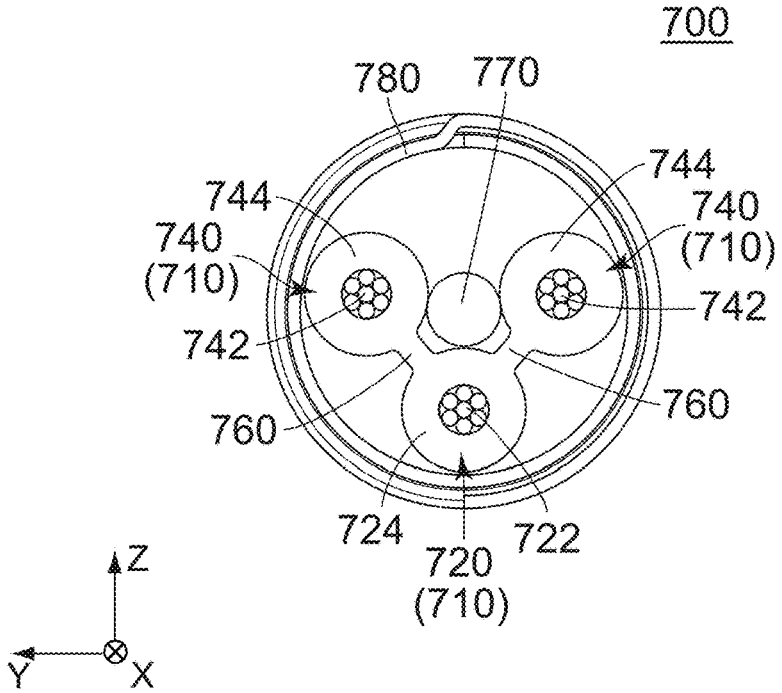
FIG. 12 is a front view showing a composite cable which is included in the cable harness of FIG. 9.

As shown in FIG. 2, the composite cable 700 of the present embodiment is attached to the connector 100. As shown in FIGS. 2 and 12, the composite cable 700 has cable sets 710 and shield portions 780. Each of the cable sets 710 has an interposing portion 770, a first cable 720, two second cables 740 and two coupling portions 760. However, the present invention is not limited thereto. The composite cable 700 may be modified, provided that the composite cable 700 has at least one cable set 710 which comprises the single first cable 720 and the two second cables 740. In other words, the composite cable 700 may have none of the coupling portion 760, the interposing portion 770 and the shield portion 780.

As shown in FIG. 12, the interposing portion 770 and the first cable 720 of the present embodiment are arranged in a perpendicular direction. In the present embodiment, the perpendicular direction is a Z-direction. Specifically, it is assumed that upward is a positive Z-direction while downward is a negative Z-direction. The interposing portion 770 is positioned between the second cables 740 in a horizontal direction. In the present embodiment, the horizontal direction is a Y-direction.

Referring to FIG. 12, the first cable 720 of the present embodiment is used for grounding. The first cable 720 has a first conductor 722 and a first cover 724. The first cover 724 covers the first conductor 722.

Referring to FIG. 12, the second cables 740 of the present embodiment are used for differential signal transmission. Each of the second cables 740 has a second conductor 742 and a second cover 744. The second cover 744 covers the second conductor 742.

Figure 13:
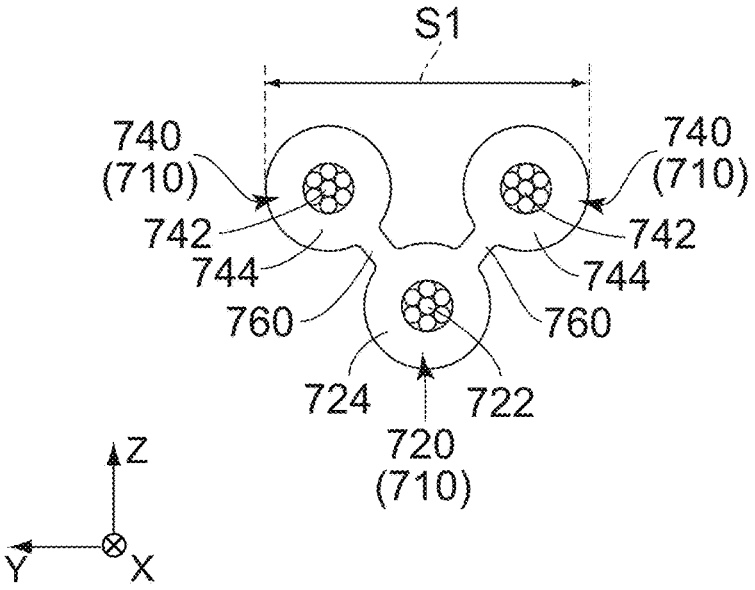
FIG. 13 is a front view showing a part of the composite cable of FIG. 12, except for omission of an interposing portion and a shield portion.

Referring to FIG. 13, each of the coupling portions 760 of the present embodiment is elastically deformable. In each of the cable sets 710, the coupling portions 760 couples the second covers 744, respectively, with the first cover 724. In each of the cable sets 710, the first cable 720, the second cables 740 and the coupling portions 760 are arranged in a V-shape in a plane which is defined by the perpendicular direction and the horizontal direction. The cable set 710 has a size S1 in the horizontal direction.

Referring to FIG. 12, each of the shield portions 780 of the present embodiment is made of conductor. The shield portions 780 are positioned outside the cable sets 710, respectively, in a direction perpendicular to a front-rear direction. In the present embodiment, the front-rear direction is an X-direction. Specifically, it is assumed that forward is a negative X-direction while rearward is a positive X-direction.

Figure 3:
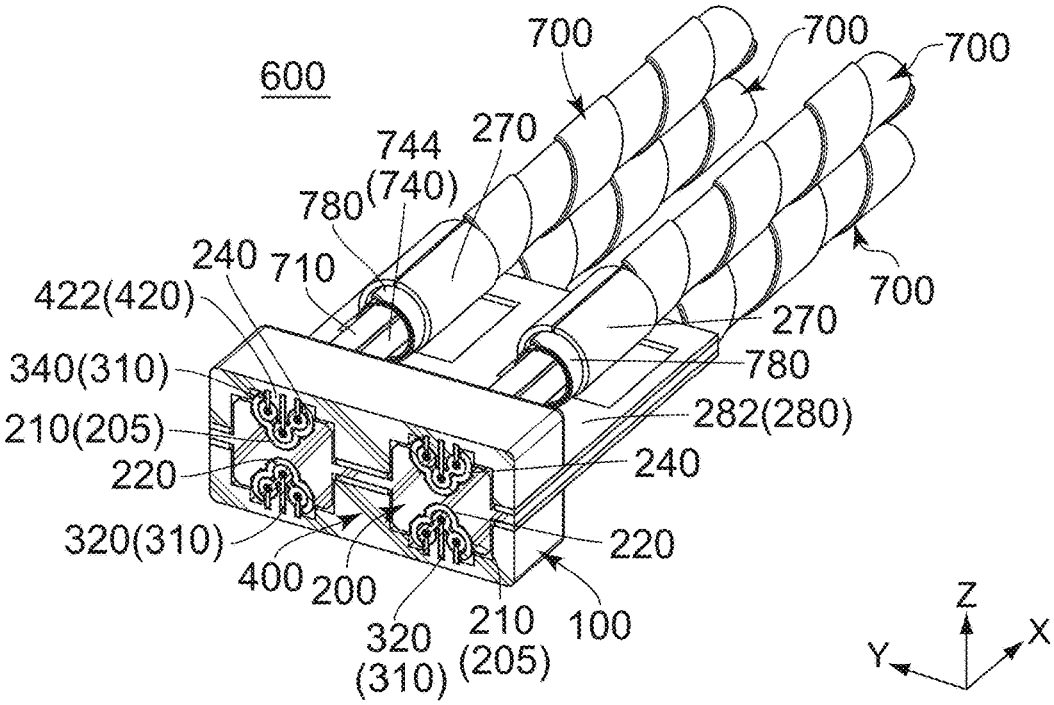
FIG. 3 is a perspective, cross-sectional view showing the cable harness of FIG. 2, taken along line A-A.
Figure 4:
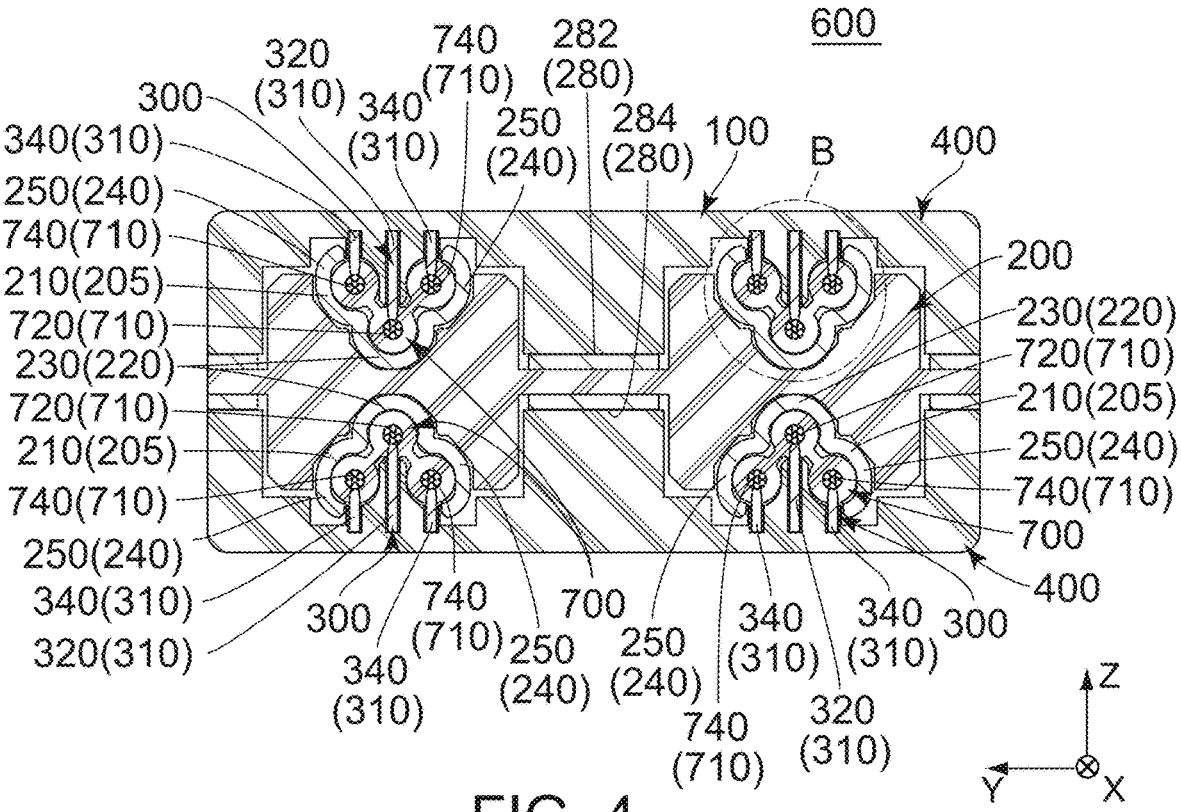
FIG. 4 is a front end view showing the cable harness of FIG. 3.

As shown in FIGS. 1, 3 and 4, the connector 100 of the present embodiment is attachable with the composite cable 700 having four cable sets 710 each of which comprises the first cable 720 and the two second cables 740. The connector 100 of the present embodiment is connectable with a mating connector 800 having mating contact portions 810. However, the present invention is not limited thereto. The connector 100 may be modified, provided that the connector 100 is attachable with a composite cable 700, which has at least one cable set 710 comprising the first cable 720 and the two second cables 740, and is mateable with the mating connector 800 having the mating contact portion 810.

As shown in FIG. 2, the connector 100 of the present embodiment has a first member 200, a plurality of terminals 300 and second members 400.

Figure 8:
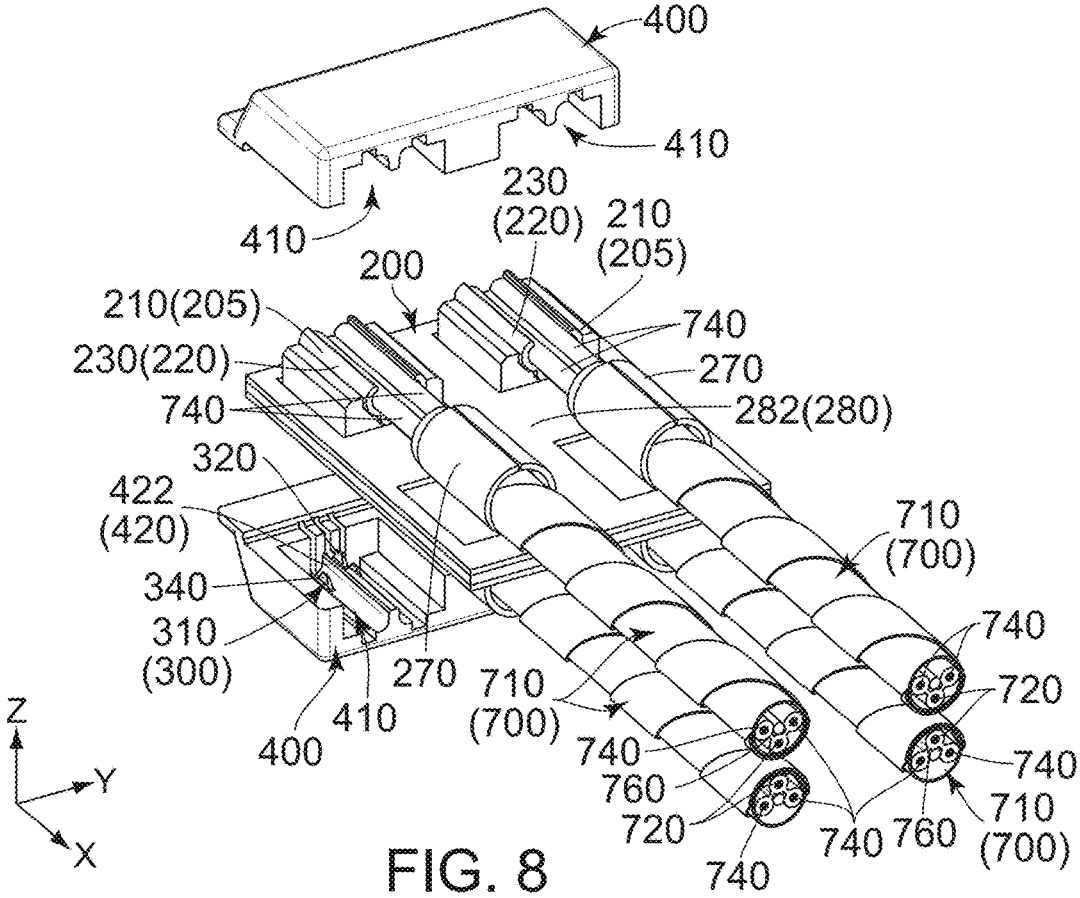
FIG. 8 is a rear, perspective view showing the cable harness of FIG. 7.

As shown in FIG. 8, the first member 200 of the present embodiment is attachable with the composite cable 700. The first member 200 has a base portion 280, a cable holding portion 205 and composite cable holding portions 270. Specifically, the base portion 280 has a flat-plate shape.

Figure 11:
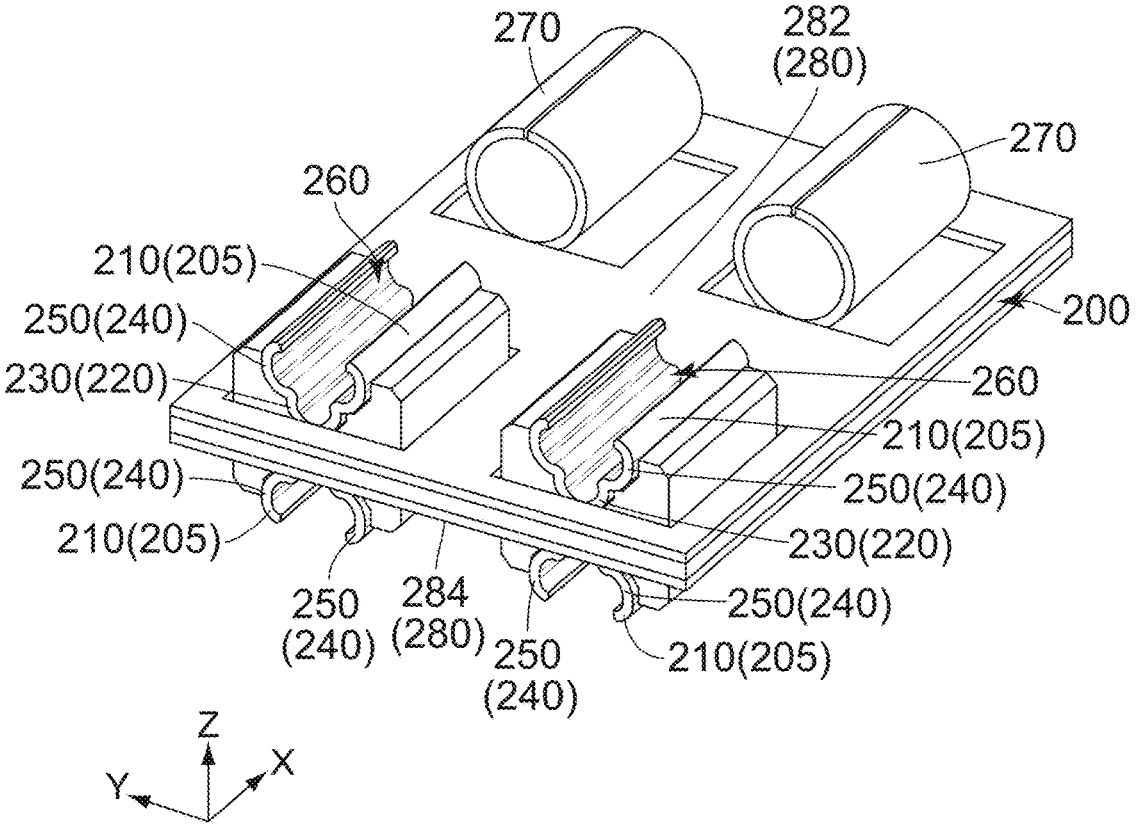
FIG. 11 is a front, perspective view showing a first member which is included in the cable harness of FIG. 9. In the figure, composite cable holding portions are swaged.

As shown in FIG. 11, the base portion 280 of the present embodiment has the flat-plate shape perpendicular to the perpendicular direction. The base portion 280 has a first principal surface 282 and a second principal surface 284. The first principal surface 282 is an upper surface of the base portion 280. The second principal surface 284 is a lower surface of the base portion 280.

As shown in FIG. 11, the cable holding portion 205 of the present embodiment is provided on the base portion 280. The cable holding portion 205 has four holding portion sets 210 each of which comprises a first cable holding portion 220 and two second cable holding portions 240. In other words, the cable holding portion 205 has a plurality of the holding portion sets 210. The holding portion sets 210 correspond to the cable sets 710, respectively. However, the present invention is not limited thereto. The cable holding portion 205 may be modified, provided that the cable holding portion 205 has at least one holding portion set 210 which comprises the first cable holding portion 220 and the two second cable holding portions 240.

As shown in FIG. 11, two of the holding portion sets 210 are positioned on the first principal surface 282, while remaining two of the holding portion sets 210 are positioned on the second principal surface 284. However, the present invention is not limited thereto. The holding portion sets 210 may be modified, provided that one of the holding portion sets 210 is positioned on the first principal surface 282 while another of the holding portion sets 210 is positioned on the second principal surface 284. Furthermore, if the cable holding portion 205 has only the single holding portion set 210, the holding portion set 210 should be positioned on one of the first principal surface 282 and the second principal surface 284. Each of the holding portion sets 210 is positioned around a front end of the base portion 280 in the front-rear direction. Each of the holding portion sets 210 is made of metal. Each of the holding portion sets 210 has a mirror-symmetrical shape with respect to a plane which is perpendicular to the horizontal direction while passing through a middle of the holding portion set 210 in the horizontal direction.

As shown in FIG. 4, in each of the holding portion sets 210, the first cable holding portion 220 is positioned between the base portion 280 and the second cable holding portion 240 in the perpendicular direction perpendicular to the base portion 280. Additionally, in each of the holding portion sets 210, the first cable holding portion 220 is positioned between the second cable holding portions 240 in the horizontal direction perpendicular to the perpendicular direction. When the first member 200 is attached with the composite cable 700, the first cable holding portion 220 holds the first cable 720.

Figure 5:
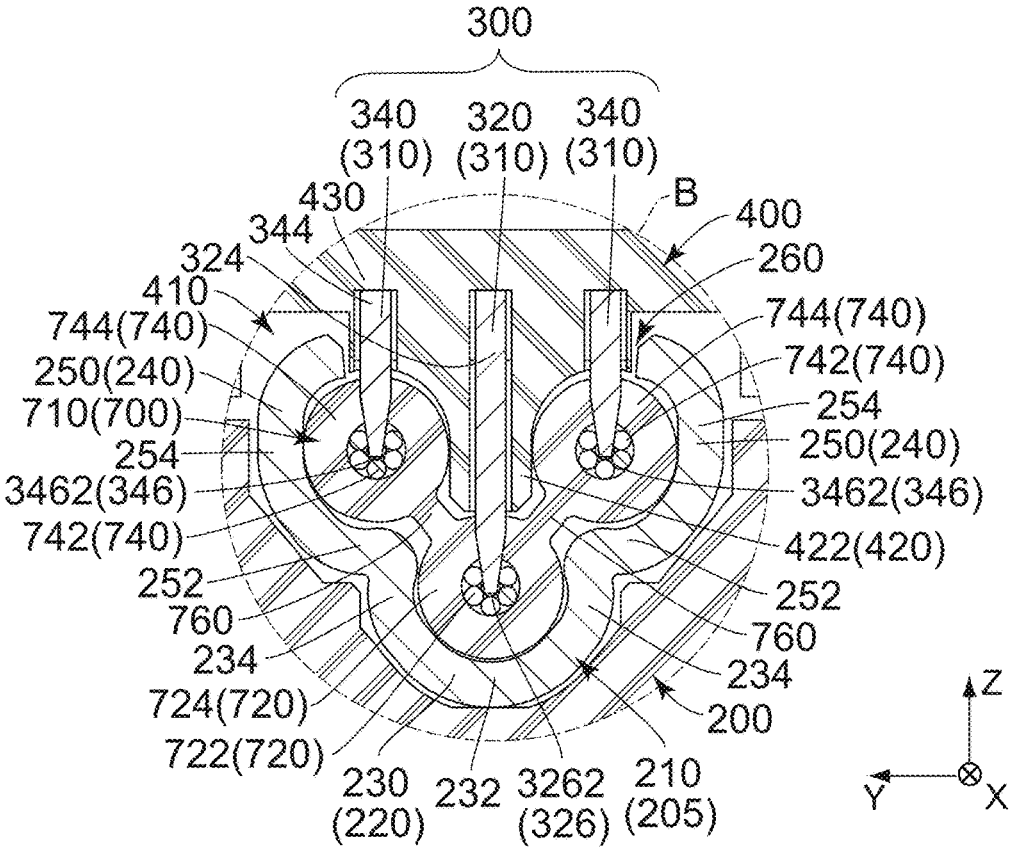
FIG. 5 is an enlarged end view showing a part of the cable harness which is enclosed by broken line B of FIG. 4.
Figure 6:
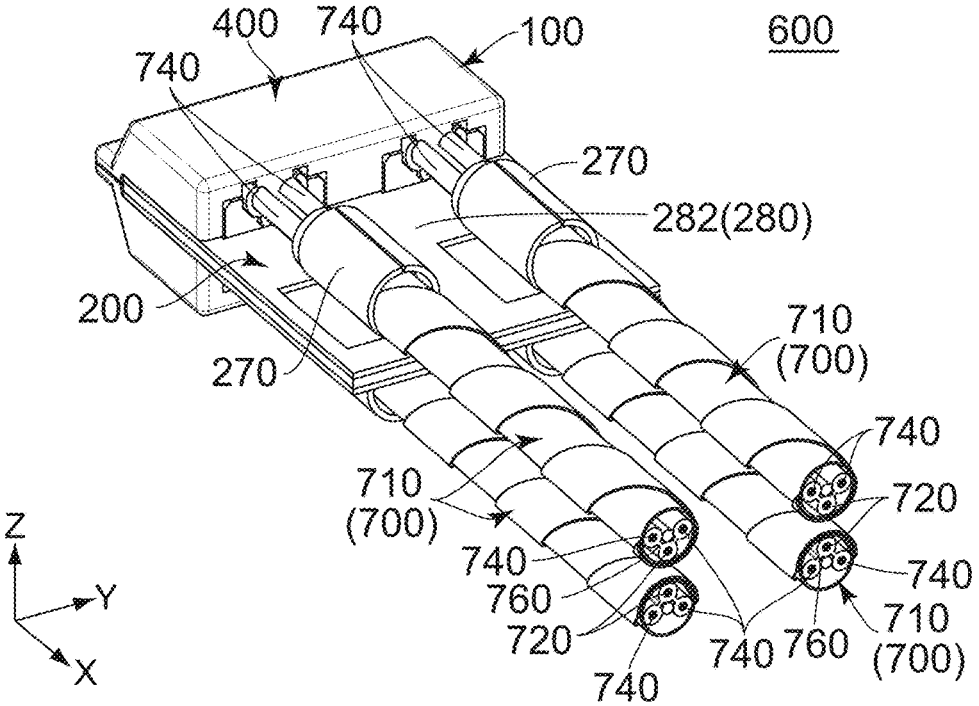
FIG. 6 is a rear, perspective view showing the cable harness of FIG. 2.
Figure 7:
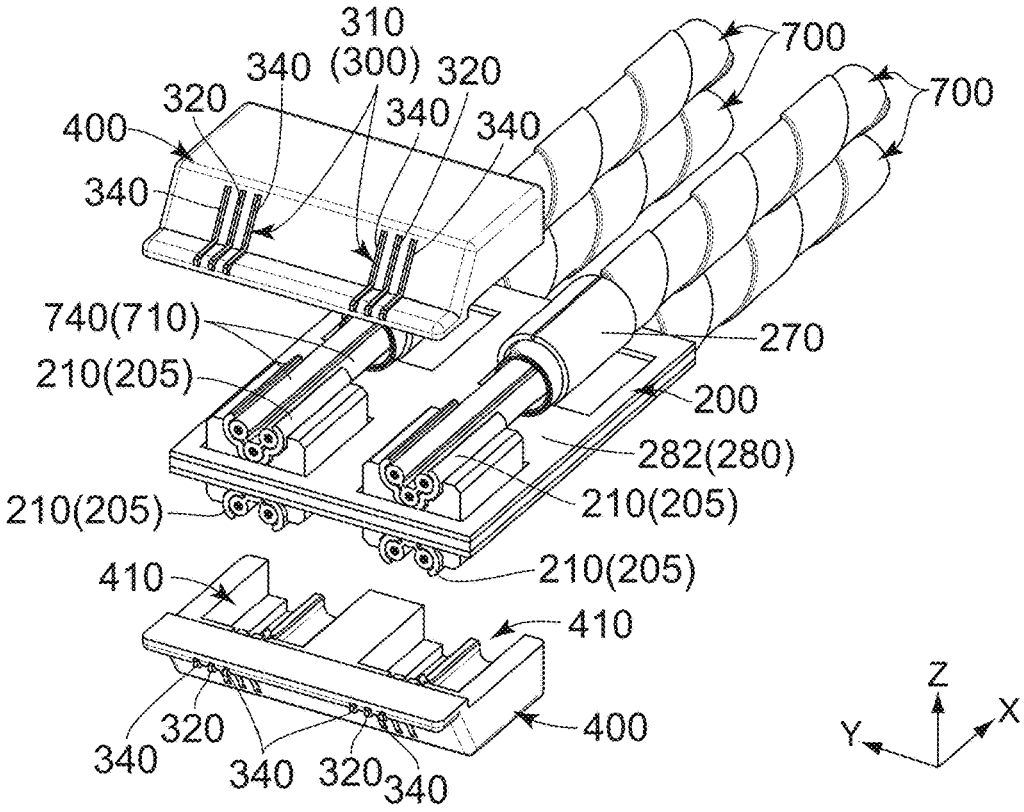
FIG. 7 is an exploded, perspective view showing the cable harness of FIG. 2.

As shown in FIG. 5, the first cable holding portion 220 of the present embodiment has a first arc portion 230. The first arc portion 230 has a circular arc cross-section in a predetermined plane perpendicular to the front-rear direction. In the present embodiment, the predetermined plane is a YZ-plane. The first arc portion 230 consists of a first bottom portion 232 and two first side portions 234. In other words, the first cable holding portion 220 has the first bottom portion 232 and the two first side portions 234. Each of the first bottom portion 232 and the first side portions 234 is a part of the first arc portion 230. As understood from FIGS. 4 and 5, the first bottom portion 232 is positioned closer to the base portion 280 than the first side portion 234 is. In other words, the first bottom portion 232 is positioned inward of the first side portion 234 in the perpendicular direction. As shown in FIG. 5, the first side portions 234 are positioned at opposite outsides, respectively, of the first bottom portion 232 in the horizontal direction.

As understood from FIGS. 4 and 5, the first bottom portion 232 regulates movement of the first cable 720 toward the base portion 280. In other words, the first bottom portion 232 regulates inward movement of the first cable 720 in the perpendicular direction. As shown in FIG. 5, the first side portions 234 regulate opposite outward movements, respectively, of the first cable 720 in the horizontal direction. More specifically, in the horizontal direction, the first side portion 234, which is positioned at a positive Y-side of the first bottom portion 232, regulates movement of the first cable 720 in a positive Y-direction. Additionally, in the horizontal direction, the first side portion 234, which is positioned at a negative Y-side of the first bottom portion 232, regulates movement of the first cable 720 in a negative Y-direction.

As shown in FIG. 5, in each of the holding portion sets 210, the second cable holding portions 240 are positioned at the same level as each other in the perpendicular direction. In each of the holding portion sets 210, the second cable holding portions 240 are positioned at opposite sides, respectively, of the first cable holding portion 220 in the horizontal direction. As shown in FIG. 4, when the first member 200 is attached with the composite cable 700, the second cable holding portions 240 hold the second cables 740, respectively. As understood from FIGS. 4 and 5, the first conductor 722 is positioned between the base portion 280 and the second cable holding portion 240 in the perpendicular direction.

As shown in FIG. 5, each of the second cable holding portions 240 of the present embodiment has a second arc portion 250. The second arc portion 250 has a circular arc cross-section in the predetermined plane. The second arc portion 250 consists of a second bottom portion 252 and a second side portion 254. In other words, each of the second cable holding portions 240 has the second bottom portion 252 and the second side portion 254. Each of the second bottom portion 252 and the second side portion 254 is a part of the second arc portion 250. As understood from FIGS. 4 and 5, the second bottom portion 252 is positioned closer to the base portion 280 than the second side portion 254 is. In other words, the second bottom portion 252 is positioned inward of the second side portion 254 in the perpendicular direction. As shown in FIG. 5, the second side portion 254 is positioned outward of the second bottom portion 252 in the horizontal direction.

As understood from FIGS. 4 and 5, the second bottom portion 252 regulates movement of the second cable 740 toward the base portion 280. In other words, the second bottom portion 252 regulates inward movement of the second cable 740 in the perpendicular direction. As shown in FIG. 5, the second side portion 254 regulates outward movement of the second cable 740 in the horizontal direction. Specifically, in the horizontal direction, the second side portion 254 of the second arc portion 250 of the second cable holding portion 240, which is positioned at a positive Y-side of the first cable holding portion 220, regulates movement of the second cable 740 in the positive Y-direction. Additionally, in the horizontal direction, the second side portion 254 of the second arc portion 250 of the second cable holding portion 240, which is positioned at a negative Y-side of the first cable holding portion 220, regulates movement of the second cable 740 in the negative Y-direction.

Figure 14:
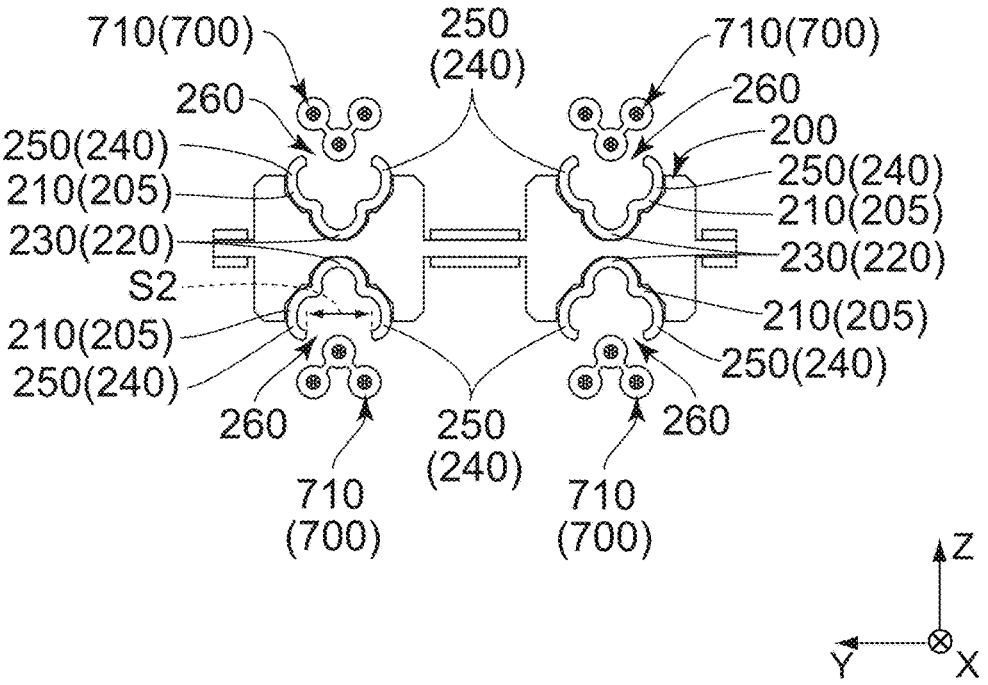
FIG. 14 is an end view for use in explaining how to connect terminals with the composite cable in the cable harness of FIG. 4. In the figure, cable sets of the composite cable are not accommodated in a cable holding portion.

As shown in FIG. 5, in each of the holding portion sets 210, the first arc portion 230 and the second arc portion 250 are coupled with each other in the predetermined plane which is defined by the perpendicular direction and the horizontal direction. More specifically, in each of the holding portion sets 210, the first side portion 234 of the first arc portion 230 and the second bottom portion 252 of the second arc portion 250 are coupled with each other in the predetermined plane which is defined by the perpendicular direction and the horizontal direction. In each of the holding portion sets 210, the first arc portion 230 of the first cable holding portion 220 is sandwiched between the second arc portions 250 of the second cable holding portions 240 in the predetermined plane As shown in FIG. 11, in each of the holding portion sets 210, the first cable holding portion 220 and the second cable holding portions 240 are integrally formed with each other. In each of the holding portion sets 210, the first cable holding portion 220 and the second cable holding portions 240 have a common opening 260 which opens in the perpendicular direction. As shown in FIG. 5, in each of the holding portion sets 210, the opening 260 is positioned between the second side portions 254 of the second arc portions 250 of the two second cable holding portions 240 in the horizontal direction. Referring to FIGS. 13 and 14, a size S2 of the opening 260 in the horizontal direction is smaller than the size S1 of the cable set 710 in the horizontal direction.

Figure 9:
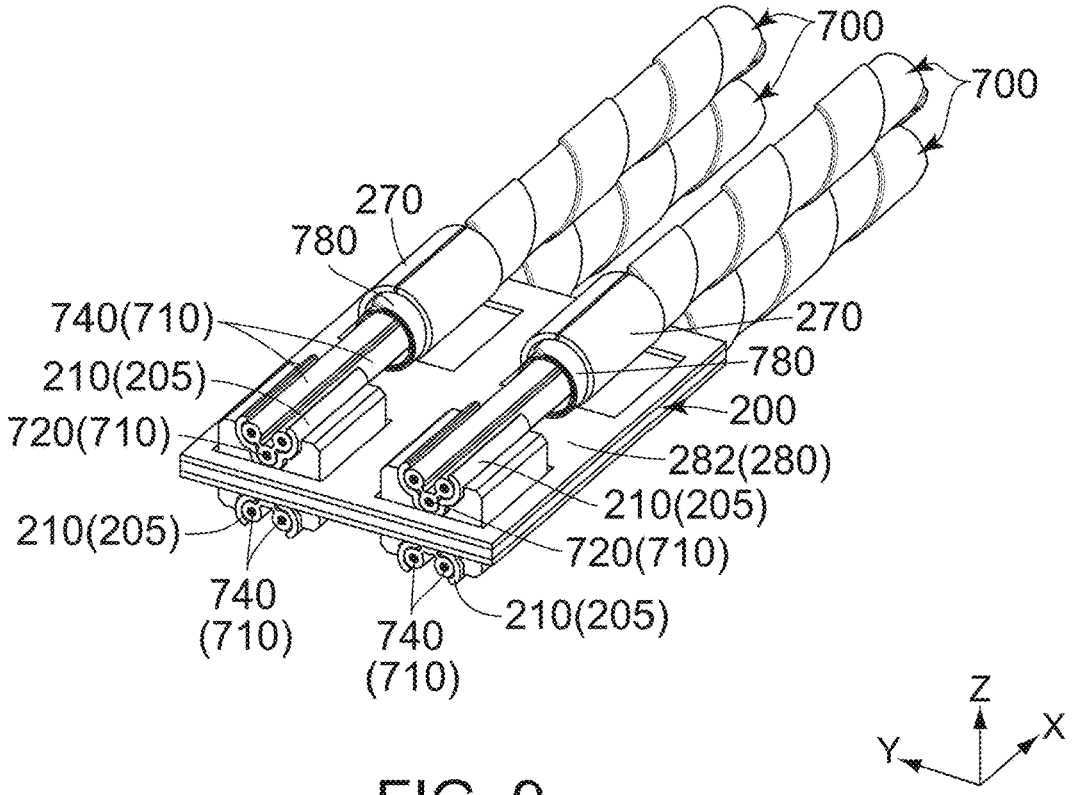
FIG. 9 is a front, perspective view showing a part of the cable harness of FIG. 7, except for omission of second members.
Figure 10:
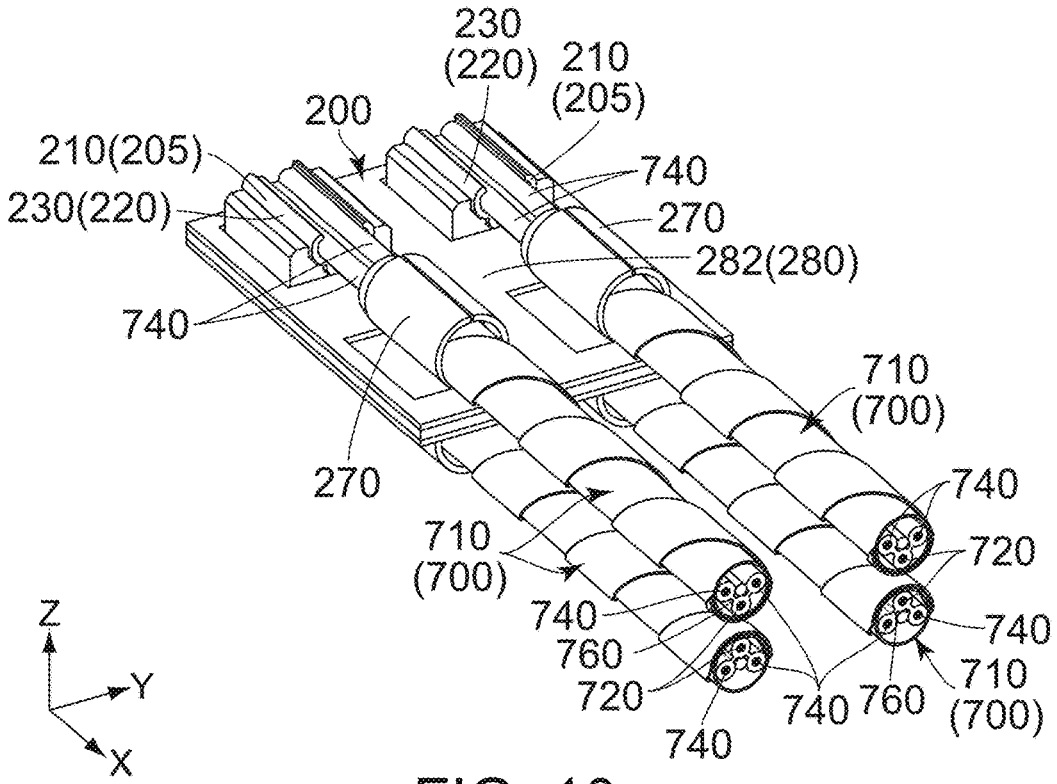
FIG. 10 is a rear, perspective view showing the cable harness of FIG. 9.

As shown in FIG. 9, each of the composite cable holding portions 270 of the present embodiment is provided on the base portion 280. Each of the composite cable holding portions 270 is positioned around a rear end of the base portion 280 in the front-rear direction. Each of the composite cable holding portions 270 is positioned away from the cable holding portion 205 in the front-rear direction perpendicular to both the perpendicular direction and the horizontal direction. In detail, the composite cable holding portions 270 correspond to the holding portion sets 210, respectively, and each of the composite cable holding portions 270 is positioned rearwardly away from the corresponding holding portion set 210 in the front-rear direction. Each of the composite cable holding portions 270 is made of metal. The composite cable holding portions 270 are configured to hold the composite cable 700. When the first member 200 is attached with the composite cable 700, the composite cable holding portions 270 are connected with the shield portions 780, respectively, of the composite cable 700.

As shown in FIG. 4, the plurality of terminals 300 of the present embodiment are held by the second member 400. The plurality of terminals 300 include four terminal sets 310 each of which comprises a first terminal 320 and two second terminals 340. The terminal sets 310 correspond to the holding portion sets 210, respectively. The terminal sets 310 correspond to the cable sets 710, respectively. However, the present invention is not limited thereto. The plurality of terminals 300 may be modified, provided that the plurality of terminals 300 include at least one terminal set 310 which comprises the first terminal 320 and the two second terminals 340.

Referring to FIGS. 2 and 5, each of the terminals 300 of the present embodiment is made of metal. Each of the terminals 300 has a contact portion 322, 342, a held portion 324, 344 and a connecting portion 326, 346. More specifically, each of the first terminals 320 has the contact portion 322, the held portion 324 and the connecting portion 326, and each of the second terminals 340 has the contact portion 342, the held portion 344 and the connecting portion 346.

As shown in FIGS. 1 and 2, the contact portion 322, 342 of the present embodiment is brought into contact with the mating contact portion 810 when the connector 100 is connected with the mating connector 800. The contact portion 322, 342 is positioned around a front end of the connector 100 in the front-rear direction.

As shown in FIGS. 1 and 5, the held portion 324, 344 of the present embodiment is held by the second member 400.

As shown in FIG. 5, the connecting portion 326, 346 of the present embodiment is connected with the composite cable 700 when the connector 100 is attached with the composite cable 700. The connecting portion 326, 346 protrudes inward in the perpendicular direction.

As shown in FIG. 5, under a connected state where the connector 100 is connected with the composite cable 700, the connecting portion 326 of the first terminal 320 pierces the first cover 724 and is connected with the first conductor 722.

As shown in FIG. 5, under the connected state when the connector 100 is connected with the composite cable 700, the connecting portion 346 of the second terminal 340 pierces the second cover 744 and is connected with the second conductor 742.

Figure 16:
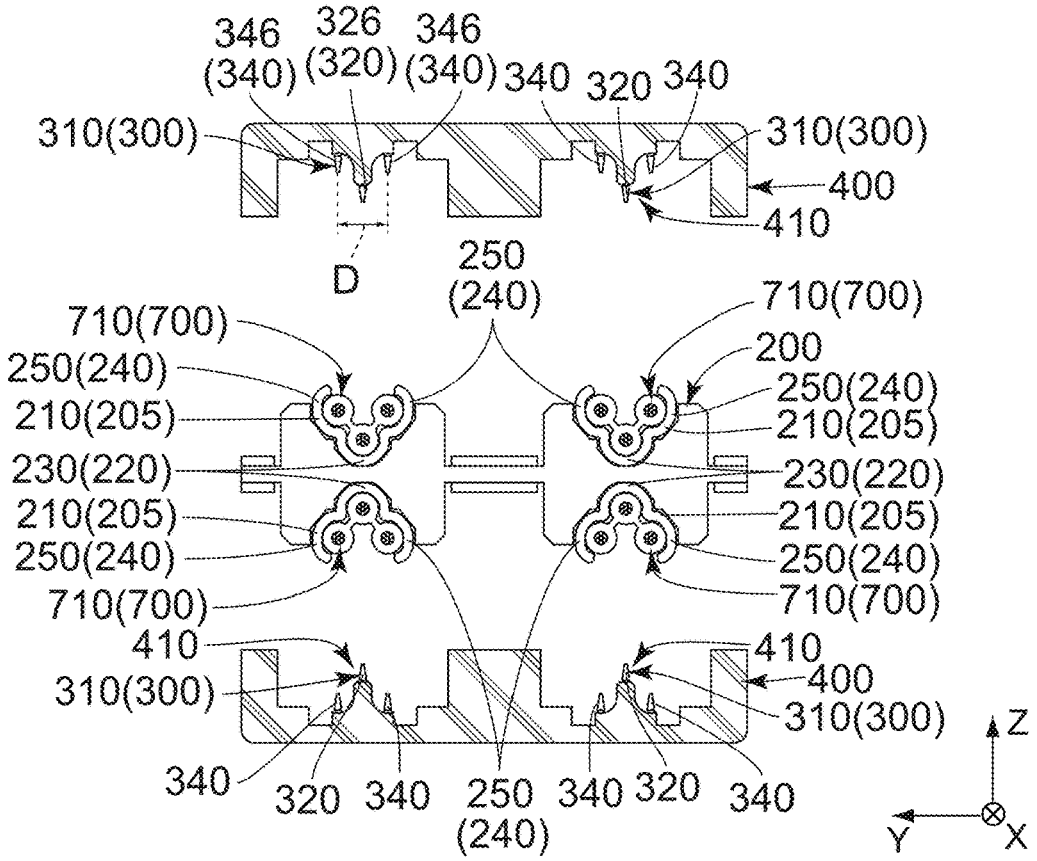
FIG. 16 is still another end view for use in explaining how to connect the terminals with the composite cable in the cable harness of FIG. 4. In the figure, the first cables of the composite cable are held by first cable holding portions of the cable holding portion while second cables of the composite cable are held by second cable holding portions of the cable holding portion.

As shown in FIG. 5, in each of the terminal sets 310, the connecting portion 326 of the first terminal 320 is positioned between the connecting portions 346 of the second terminals 340 in the horizontal direction. Referring to FIGS. 14 and 16, a distance D between the connecting portions 346 of the second terminals 340 of the terminal set 310 in the horizontal direction is smaller than the size S2 of the opening 260 in the horizontal direction. As shown in FIG. 5 again, an end 3262 of the connecting portion 326 of the first terminal 320 is positioned inward of an end 3462 of the connecting portion 346 of the second terminal 340 in the perpendicular direction.

Figure 18:
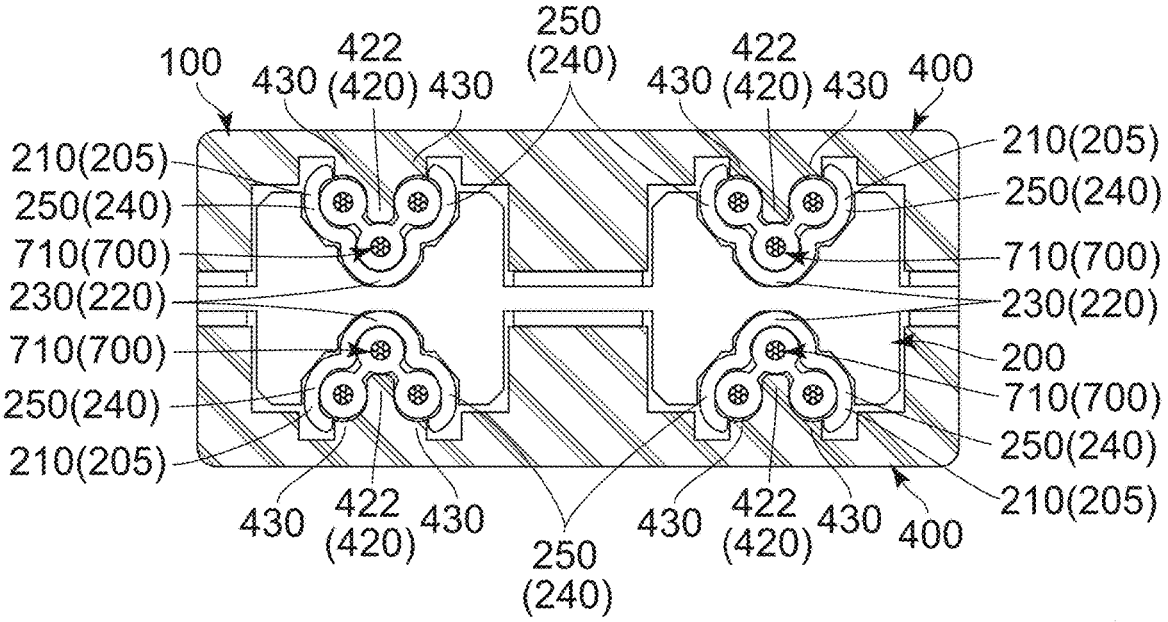
FIG. 18 is yet still another end view for use in explaining how to connect the terminals with the composite cable in the cable harness of FIG. 4. In the figure, the connecting portions of the first terminals are connected with the first cables while the connecting portions of the second terminals are connected with the second cables.
Figure 18:
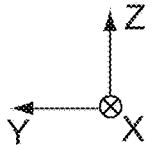
Figure 19:
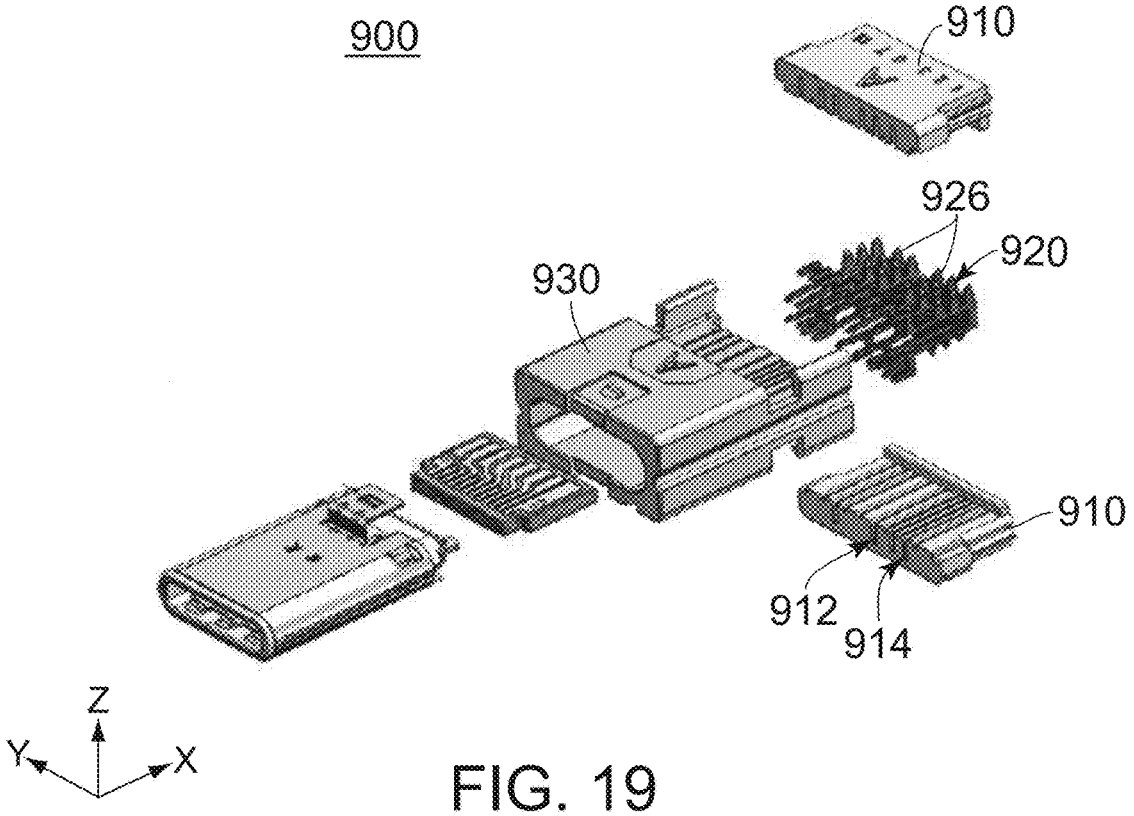
FIG. 19 PRIOR ART
FIG. 19 is an exploded, perspective view showing a connector of Patent Document 1.
Figure 20:
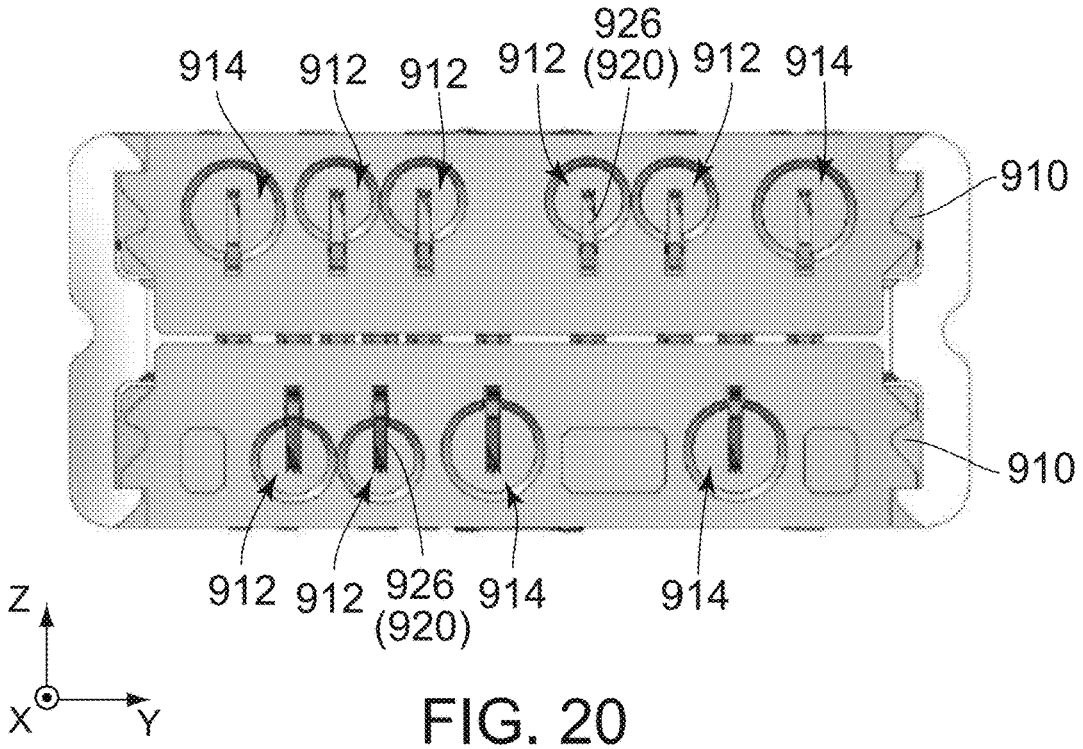
FIG. 20 PRIOR ART
FIG. 20 is a rear view showing the connector of FIG. 19.
Figure 21:
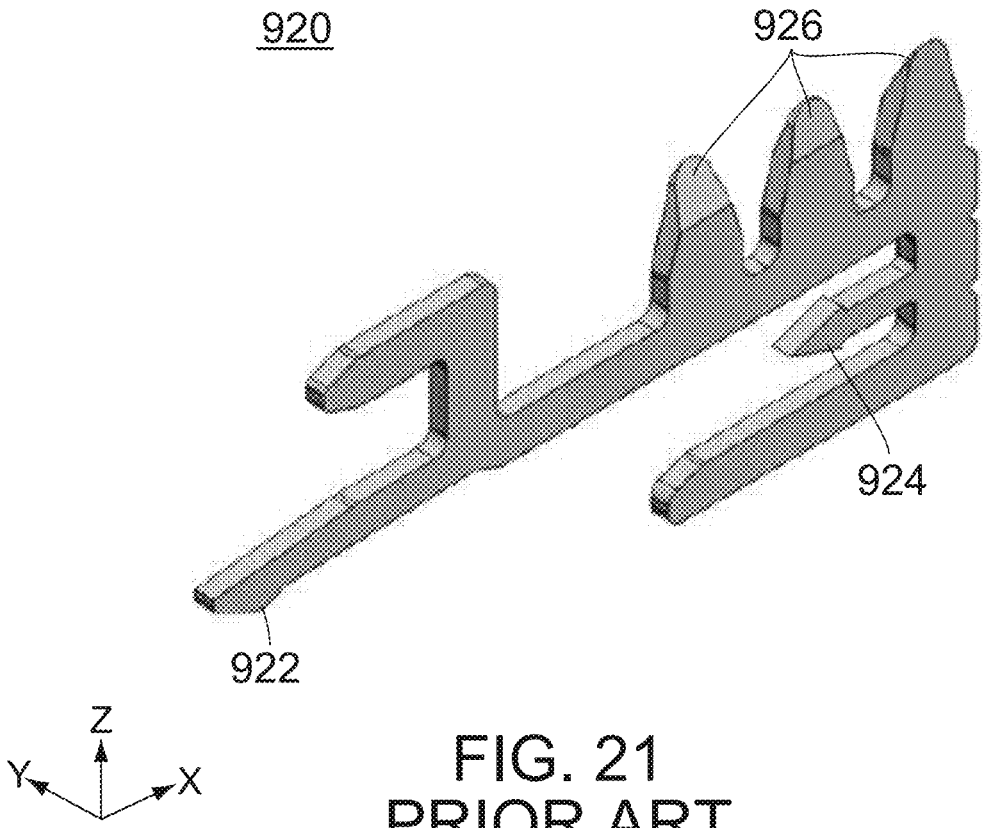
FIG. 21 PRIOR ART
FIG. 21 is a perspective view showing one of terminals which are included in the connector of FIG. 19.

As shown in FIG. 18, each of the second members 400 of the present embodiment is combined with the first member 200.

As understood from FIGS. 4 and 5, under a combined state where the second member 400 is combined with the first member 200, the end 3262 of the connecting portion 326 of the first terminal 320 is positioned between the end 3462 of the connecting portion 346 of the second terminal 340 and the base portion 280 in the perpendicular direction. Under the combined state, the end 3262 of the connecting portion 326 of the first terminal 320 is positioned closer to the base portion 280 than the end 3462 of the connecting portion 346 of the second terminal 340 is.

Figure 17:
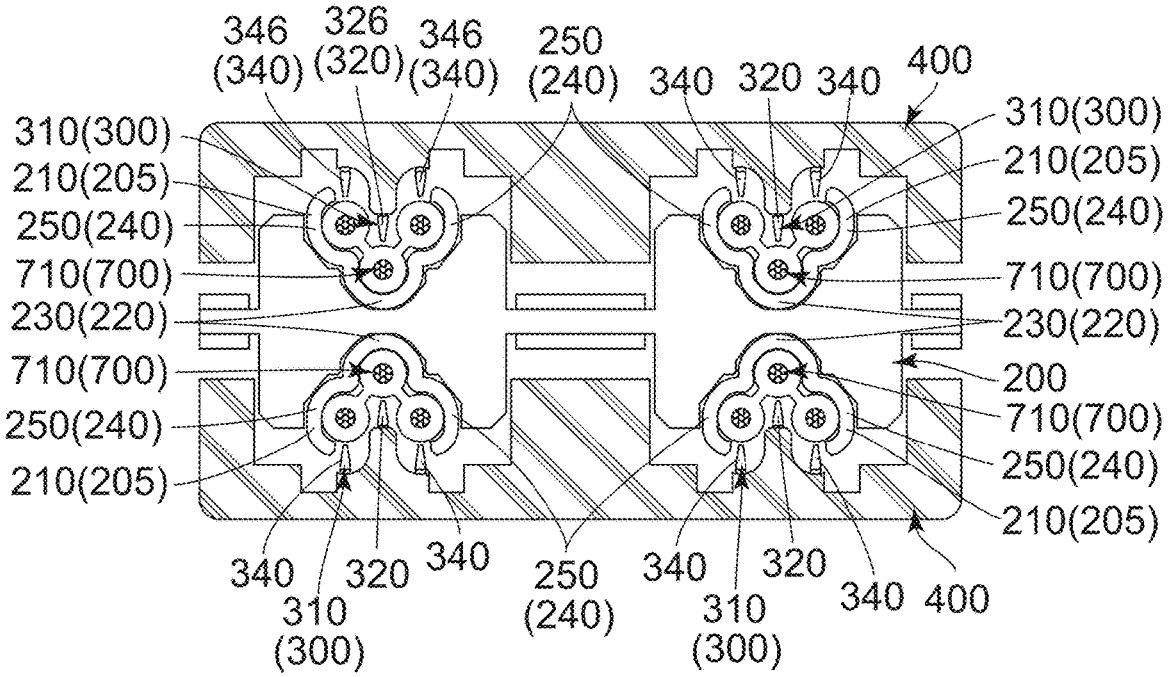
FIG. 17 is yet another end view for use in explaining how to connect the terminals with the composite cable in the cable harness of FIG. 4. In the figure, connecting portions of first terminals extend toward the first cables through openings of the cable holding portion while connecting portions of second terminals extend toward the second cables through the openings of the cable holding portion.
Figure 17:
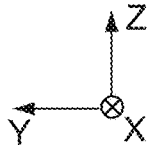

Referring to FIGS. 5 and 17, if the connector 100 is not connected with the composite cable 700 under the combined state, the connecting portion 326 of the first terminal 320 extends toward the first cable holding portion 220 in the perpendicular direction. More specifically, if the connector 100 is not connected with the composite cable 700 under the combined state, the connecting portion 326 of the first terminal 320 extends toward the first cable holding portion 220 through the opening 260.

Referring to FIGS. 5 and 17, if the connector 100 is not connected with the composite cable 700 under the combined state, the connecting portion 346 of the second terminal 340 extends toward the second cable holding portion 240 in the perpendicular direction. More specifically, if the connector 100 is not connected with the composite cable 700 under the combined state, the connecting portion 346 of the second terminal 340 extends toward the second cable holding portion 240 through the opening 260.

As shown in FIG. 5, each of the second members 400 of the present embodiment has an accommodating portion 410, first terminal holding portions 420 and second terminal holding portions 430.

As shown in FIG. 5, the accommodating portion 410 of the present embodiment accommodates, at least in part, the cable holding portion 205 when the second member 400 is combined with the first member 200.

Referring to FIGS. 5 and 17, if the connector 100 is not connected with the composite cable 700 under the combined state where the second member 400 is combined with the first member 200, the connecting portion 326, 346 is exposed in the accommodating portion 410 and protrudes toward an inside of the accommodating portion 410.

As shown in FIG. 5, the first terminal holding portion 420 of the present embodiment holds the held portion 324 of the first terminal 320.

As shown in FIG. 5, the first terminal holding portion 420 of the present embodiment has a movement regulating portion 422. In each of the holding portion sets 210 under the combined state, the movement regulating portion 422 is positioned between the second cables 740 in the horizontal direction. Under the combined state, the movement regulating portion 422 regulates inward movement of the second cable 740 in the horizontal direction. More specifically, in each of the holding portion sets 210 under the combined state, the movement regulating portion 422 regulates movement of the second cable 740, which is positioned at a positive Y-side of the cable set 710, in the negative Y-direction. Additionally, in each of the holding portion sets 210 under the combined state, the movement regulating portion 422 regulates movement of the second cable 740, which is positioned at a negative Y-side of the cable set 710, in the positive Y-direction. However, the present invention is not limited thereto. One of the connecting portion 326 of the first terminal 320 and the first terminal holding portion 420 may have a movement regulating portion 422 which regulates inward movement of the second cable 740 in the horizontal direction.

As shown in FIG. 5, the second terminal holding portion 430 of the present embodiment holds the held portion 344 of the second terminal 340.

Referring to FIGS. 11 to 18, a method of attaching the connector 100 with the composite cable 700 is described in detail hereinafter.

Referring to FIGS. 12 to 14, first, the shield portion 780 of the composite cable 700 is folded rearward so that a part of the cable set 710 is exposed outside the composite cable 700. Next, a part of the interposing portion 770, which is exposed outside the composite cable 700, is removed and the part of the cable set 710 is arranged outward in the perpendicular direction beyond the corresponding holding portion set 210 of the first member 200. Meanwhile, the shield portion 780 of the composite cable 700 is positioned outward in the perpendicular direction beyond an opening (not shown) of the corresponding composite cable holding portion 270 which is not yet swaged.

Figure 15:
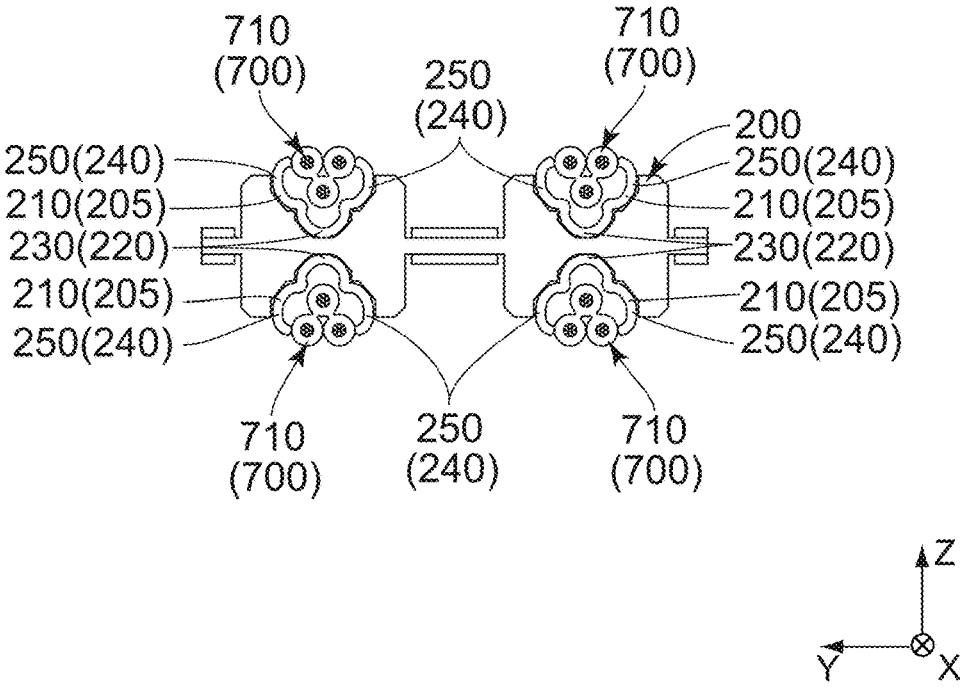
FIG. 15 is another end view for use in explaining how to connect the terminals with the composite cable in the cable harness of FIG. 4. In the figure, first cables of the cable sets of the composite cable are accommodated in the cable holding portion.

Referring to FIGS. 14 and 15, when the cable set 710 is moved toward the corresponding holding portion set 210, the first cable 720 is accommodated in the cable holding portion 205 through the opening 260 while the second cables 740 are brought into contact with the second side portions 254 of the second arc portions 250 of the second cable holding portions 240, respectively, in the perpendicular direction.

When a force is applied to the cable set 710 in this state so that cable set 710 and the corresponding holding portion set 210 approach each other in the perpendicular direction, the coupling portions 760 (see FIG. 13) are elastically deformed so that the cable set 710 has a reduced distance between the second cables 740 in the horizontal direction. Then, the second cables 740 are accommodated in the cable holding portion 205 through the opening 260 so that the first member 200 and the composite cable 700 reach a state shown in FIG. 16.

Meanwhile, the first cable 720 is held by the first cable holding portion 220 while the second cables 740 are held by the second cable holding portions 240, respectively. As described above, the size S2 of the opening 260 in the horizontal direction is smaller than the size S1 of the cable set 710 in the horizontal direction. Thus, the cable set 710, which is accommodated in the cable holding portion 205, is prevented from being moved out from the cable holding portion 205 in the predetermined direction through the opening 260.

Also meanwhile, the shield portion 780 of the composite cable 700 is accommodated in the corresponding composite cable holding portion 270 through the opening (not shown). After that, each of the composite cable holding portions 270 is swaged as shown in FIG. 9. Then, the composite cable 700 is held by the composite cable holding portions 270 and each of the shield portions 780 of the composite cable 700 is connected with the corresponding composite cable holding portion 270. Thus, the composite cable 700 is attached to the first member 200.

Next, referring to FIG. 16, the second member 400 is positioned relative to the first member 200 and the composite cable 700 so that the terminal set 310 is positioned outward in the perpendicular direction beyond the corresponding cable set 710. Meanwhile, the connecting portion 326 of the first terminal 320 of the terminal set 310 is positioned outward in the perpendicular direction beyond the first cable 720 of the corresponding cable set 710 while the connecting portion 346 of the second terminal 340 of the terminal set 310 is positioned outward in the perpendicular direction beyond the second cable 740 of the corresponding cable set 710.

After that, referring to FIG. 17, the second member 400 is moved toward the first member 200 in the perpendicular direction. Then, the connecting portion 326 of the first terminal 320 of the terminal set 310 of the second member 400 is brought into contact with the first cable 720 of the corresponding cable set 710 in the perpendicular direction through the opening 260, while the connecting portions 346 of the second terminals 340 of the terminal set 310 of the second member 400 are brought into contact with the second cables 740, respectively, of the corresponding cable set 710 in the perpendicular direction through the opening 260. As described above, the distance D (see FIG. 16) between the connecting portions 346 of the second terminals 340 of the terminal set 310 in the horizontal direction is smaller than the size S2 (see FIG. 14) of the opening 260 in the horizontal direction. Thus, in the aforementioned movement of the second member 400, the connecting portion 346 of the second terminal 340 can be brought into contact with the second cable 740 through the opening 260 without being brought into contact with the second side portion 254 of the second arc portion 250 of the second cable holding portion 240.

Referring to FIGS. 4, 5, 17 and 18, a force is applied to the second member 400 in this state so that the second member 400 and the first member 200 further approach each other in the predetermined direction. Then, the connecting portion 326 of the first terminal 320 of the terminal set 310 of the second member 400 pierces the first cover 724 of the first cable 720 of the corresponding cable set 710 and is connected with the first conductor 722, while the connecting portion 346 of the second terminal 340 of the terminal set 310 of the second member 400 pierces the second cover 744 of the second cable 740 of the corresponding cable set 710 and is connected with the second conductor 742. Consequently, the composite cable 700 is attached to the connector 100.

Although the specific explanation about the present invention is made above referring to the embodiments, the present invention is not limited thereto and is susceptible to various modifications and alternative forms.

The connector 100 may be modified to be used as a substitute for a relay board which is used for a connector in accordance with a USB (Universal Serial Bus) Type-C standard.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector attachable with a composite cable and connectable with a mating connector having a mating contact portion, the composite cable having at least one cable set which comprises a first cable and two second cables, wherein:

the connector has a first member, a plurality of terminals and a second member;

the first member is attachable with the composite cable;

the first member has a base portion and a cable holding portion;

the base portion has a flat-plate shape;

the cable holding portion is provided on the base portion;

the cable holding portion has at least one holding portion set which comprises a first cable holding portion and two second cable holding portions;

in the at least one holding portion set, the first cable holding portion is positioned between the base portion and the second cable holding portion in a perpendicular direction perpendicular to the base portion and is positioned between the second cable holding portions in a horizontal direction perpendicular to the perpendicular direction;

in the at least one holding portion set, the second cable holding portions are positioned at the same level as each other in the perpendicular direction;

when the first member is attached with the composite cable, the first cable holding portion holds the first cable and the second cable holding portions hold the second cables, respectively;

the plurality of terminals are held by the second member;

the plurality of terminals include at least one terminal set which comprises a first terminal and two second terminals;

each of the terminals has a contact portion, a held portion and a connecting portion;

the contact portion is brought into contact with the mating contact portion when the connector is connected with the mating connector;

the held portion is held by the second member;

the connecting portion is connected with the composite cable when the connector is attached with the composite cable;

the connecting portion has an end in the perpendicular direction;

in the at least one terminal set, the connecting portion of the first terminal is positioned between the connecting portions of the second terminals in the horizontal direction;

the second member is combined with the first member;

the second member has an accommodating portion;

the accommodating portion accommodates, at least in part, the cable holding portion when the second member is combined with the first member;

under a combined state where the second member is combined with the first member, the connecting portion is exposed in the accommodating portion and protrudes toward an inside of the accommodating portion;

under the combined state, the connecting portion of the first terminal extends toward the first cable holding portion in the perpendicular direction;

under the combined state, the connecting portion of the second terminal extends toward the second cable holding portion in the perpendicular direction; and under the combined state, the end of the connecting portion of the first terminal is positioned between the end of the connecting portion of the second terminal and the base portion in the perpendicular direction.

2. The connector as recited in claim 1, wherein:

the first cable holding portion has a first bottom portion and two first side portions;

the first bottom portion regulates movement of the first cable toward the base portion;

the first side portions regulate opposite outward movements, respectively, of the first cable in the horizontal direction;

each of the second cable holding portions has a second bottom portion and a second side portion;

the second bottom portion regulates movement of the second cable toward the base portion;

the second side portion regulates outward movement of the second cable in the horizontal direction;

the second member has a first terminal holding portion;

the first terminal holding portion holds the held portion of the first terminal;

one of the connecting portion of the first terminal and the first terminal holding portion has a movement regulating portion; and under the combined state, the movement regulating portion regulates inward movement of the second cable in the horizontal direction.

3. The connector as recited in claim 2, wherein:

the first cable holding portion has a first arc portion;

each of the first bottom portion and the first side portions is a part of the first arc portion;

the second cable holding portion has a second arc portion;

each of the second bottom portion and the second side portion is a part of the second arc portion;

in the at least one holding portion set, the first arc portion and the second arc portion are coupled with each other in a predetermined plane which is defined by the perpendicular direction and the horizontal direction; and in the at least one holding portion set, the first arc portion of the first cable holding portion is sandwiched between the second arc portions of the second cable holding portions in the predetermined plane.

4. The connector as recited in claim 1, wherein:

in the at least one holding portion set, the first cable holding portion and the second cable holding portions are integrally formed with each other;

in the at least one holding portion set, the first cable holding portion and the second cable holding portions have a common opening which opens in the perpendicular direction;

under the combined state, the connecting portion of the first terminal extends toward the first cable holding portion through the opening; and under the combined state, the connecting portion of the second terminal extends toward the second cable holding portion through the opening.

5. The connector as recited in claim 1, wherein:

the first member further has a composite cable holding portion which is configured to hold the composite cable;

the composite cable holding portion is provided on the base portion; and the composite cable holding portion is positioned away from the cable holding portion in a front-rear direction perpendicular to both the perpendicular direction and the horizontal direction.

6. The connector as recited in claim 5, wherein:

the cable holding portion has a plurality of the holding portion sets;

the base portion has a first principal surface and a second principal surface;

one of the holding portion sets is positioned on the first principal surface; and another of the holding portion sets is positioned on the second principal surface.

7. A cable harness comprising the connector as recited in claim 1 and the composite cable, wherein:

the composite cable is attached to the connector;

the composite cable has the at least one cable set which comprises the first cable and the two second cables;

the first cable has a first conductor and a first cover;

the first cover covers the first conductor;

each of the second cables has a second conductor and a second cover;

the second cover covers the second conductor;

the connecting portion of the first terminal pierces the first cover and is connected with the first conductor; and the connecting portion of the second terminal pierces the second cover and is connected with the second conductor.

8. The cable harness as recited in claim 7, wherein the first conductor is positioned between the base portion and the second cable holding portion in the perpendicular direction.

9. The cable harness as recited in claim 7, wherein:

the at least one cable set has two coupling portions;

in the at least one cable set, the coupling portions couple the second covers, respectively, with the first cover; and in the at least one cable set, the first cable, the second cables and the coupling portions are arranged in a V-shape in a plane which is defined by the perpendicular direction and the horizontal direction.

10. The cable harness as recited in claim 7, wherein:

the first cable is used for grounding; and the second cables are used for differential signal transmission.

* * * * *